US005637444A

United States Patent [19]

Matsumoto

[11] Patent Number: 5,637,444

[45] Date of Patent: Jun. 10, 1997

[54] COMPOSITION FOR LITHOGRAPHIC PRINTING FOUNTAIN SOLUTION

[75] Inventor: Hiroshi Matsumoto, Shizuoka, Japan

[73] Assignee: Fuji Photo Film Co., Ltd., Minami-ashigara, Japan

[21] Appl. No.: 530,616

[22] Filed: Sep. 20, 1995

[30] Foreign Application Priority Data

Oct. 14, 1994 [JP] Japan ..... 6-249628

[51] Int. Cl.[6] ..... G03C 5/40

[52] U.S. Cl. ..... 430/331; 430/302; 430/309

[58] Field of Search ..... 525/59, 327.8, 525/329.6; 430/302, 309, 331

[56] References Cited

U.S. PATENT DOCUMENTS

| | | | |
|---|---|---|---|
| 3,793,228 | 2/1974 | Kandler et al. | 525/327.8 |
| 4,172,930 | 10/1979 | Kajitani et al. | 525/56 |
| 4,731,291 | 3/1988 | Kerkhoff et al. | 428/342 |
| 5,163,999 | 11/1992 | Uchita et al. | 106/2 |
| 5,165,344 | 11/1992 | Matsumoto et al. | 101/451 |
| 5,194,418 | 3/1993 | Miyauchi et al. | 503/226 |
| 5,296,336 | 3/1994 | Doi et al. | 430/331 |
| 5,387,638 | 2/1995 | Nakamae et al. | 524/503 |

FOREIGN PATENT DOCUMENTS

| | | |
|---|---|---|
| 4170405 | 6/1992 | Japan . |
| 822061 | 10/1959 | United Kingdom . |

*Primary Examiner*—Hoa Van Le

*Attorney, Agent, or Firm*—Burns, Doane, Swecker & Mathis, LLP

[57] ABSTRACT

A composition for a lithographic printing fountain solution is described, which comprises polyvinyl alcohol containing itaconic acid, maleic acid, maleic anhydride or ester thereof in an amount of from 1 to 10 mol % per molecule as a copolymer component and having a saponification degree of from 80 to 100 mol %.

6 Claims, No Drawings

COMPOSITION FOR LITHOGRAPHIC PRINTING FOUNTAIN SOLUTION

FIELD OF THE INVENTION

This invention relates to a composition for a fountain solution useful for offset printing process of a lithographic printing plate.

BACKGROUND OF THE INVENTION

Generally, a lithographic printing plate is prepared from a light-sensitive lithographic printing plate which is called a presensitized (PS) plate.

Lithographic printing is a printing system taking advantage of a property that water and oil are essentially immiscible, and the surface of the printing plate comprises an area which receives water and repels an oily ink and an area which repels water and receives the oily ink. The former is a non-image area and the latter is an image area. Further, a boundary chemical difference between the image area and the non-image area is broadened by moistening the non-image area with a fountain solution thereby increasing the ink-repellency in the non-image area and the ink-receptivity in the image area.

The fountain solution which has been conventionally known includes an aqueous solution containing a colloidal material such as an alkali metal salt or an ammonium salt of dichromic acid, phosphoric acid or a salt thereof, for example, an ammonium salt.

Also, a water-soluble polymeric compound as a stain preventing component is usually incorporated into the fountain solution. The water-soluble polymeric compound is effective for stable printing by preventing stains of the non-image area of the printing plate or stains of water supply rolls of the printing machine. Such water-soluble polymeric compounds include natural substances such as gum arabic, cellulose and derivatives thereof (for example, carboxymethyl cellulose, carboxyethyl cellulose, methyl cellulose, hydroxypropyl cellulose, hydroxypropylmethyl cellulose, ethyl cellulose), starch derivatives (for example, dextrin, enzyme-decomposed dextrin, hydroxypropylated starch, carboxymethyl starch, phosphorated starch, octenylsuccinated starch), and alginic acid and derivatives thereof (for example, hydroxypropyl alginic acid, hydroxyethyl alginic acid); and synthetic hydrophilic polymers such as polyethylene glycol and copolymers thereof, polyvinyl alcohol and copolymers thereof, polyvinylpyrrolidone, polyacrylamide and copolymers thereof, polyacrylic acid and copolymers thereof, polystyrenesulfonic acid and copolymers thereof, and a vinyl acetate/maleic anhydride copolymer.

However, the fountain solution containing only these compounds has a defect in that it is difficult to uniformly dampen the non-image area of the plate, and, thus, there are problems such that prints are sometimes stained and a skilled technique is required for adjusting the amount of the fountain solution to be supplied.

Also, gum arabic which has the most excellent performance among these compounds is produced mainly in Sudan which is one of the countries of the gum arabic belt zone in the African Continent, but in recent years the availability of gum arabic becomes to be unstable due to natural conditions such as drought and the instability in the political situation. For this reason, development of hydrophilic polymers as a substitute therefor has been strongly desired.

In particular, carboxymethyl cellulose, among others, has an ability to prevent stains similar to gum arabic, but the solubility of carboxymethyl cellulose markedly decreases in an acidic pH range where the fountain solution is generally used, and, when a running processing is conducted using a pH automatic controller, a dropping nozzle of the fountain solution tends to be clogged. Generally, a commercial product of a fountain solution is concentrated for an economical reason and is diluted with water when it is used for printing. In such a case, concentration of a fountain solution containing carboxymethyl cellulose is difficult to attain because of its low solubility.

In the present invention, the concentrated fountain solution is hereinafter referred to as a composition for a fountain solution.

In addition, a Dahlgren system using an aqueous solution containing isopropyl alcohol in an amount of from about 20 to 25% as a fountain solution has been proposed. This system is advantageous in that wettability in the non-image area can be improved and adjustment in the balance of supplying amounts of printing ink and water is easy.

However, since isopropyl alcohol tends to easily evaporate, a particular apparatus is required for maintaining the concentration of isopropyl alcohol at a constant value thereby increasing the cost of the system. Further, the use of isopropyl alcohol is undesirable from the standpoint of the working environment since it has an unpleasant odor and also has a toxic problem. Furthermore, when isopropyl alcohol and gum arabic are used together, emulsification is decreased and a composition having a high concentration over 15% cannot be obtained.

Recently, social concern for industrial pollution has been increased, and exhaust of chromium ions in waste has become strictly regulated, and also the use of organic solvents such as isopropyl alcohol tends to be restricted from a safety standpoint. For this reason, a fountain solution containing no chromium ions and isopropyl alcohol has been desired.

In order to solve the above problems, compositions for a fountain solution containing various surface active agents have been proposed in, for example, JP-B-55-25075, JP-B-55- 19757 and JP-B-58-5797 (the term "JP-B" as used herein means an examined Japanese patent publication), but these compositions are still unsatisfactory for solving the above problems. Further, the fountain solution containing these surface active agents have problems in that they tend to foam when the fountain solution is transported by pumping or stirred.

On the other hand, U.S. Pat. No. 3,877,372 discloses a fountain solution containing a mixture of ethylene glycol monobutyl ether and at least one of hexylene glycol and ethylene glycol. Also, U.S. Pat. No. 4,278,467 discloses a fountain solution containing at least one of n-hexoxydiethylene glycol, n-hexoxyethylene glycol, 2-ethyl-1,3-hexanediol, n-butoxyethylene glycol acetate, n-butoxydiethylene glycol acetate, and 3-butoxy-2-propanol. JP-A-57-199693 discloses a fountain solution containing 2-ethyl-1,3-hexanediol and at least one of completely water-soluble propylene glycol, ethylene glycol, dipropylene glycol, diethylene glycol, hexylene glycol, triethylene glycol, tetraethylene glycol, tripropane glycol and 1,5-pentanediol. (The term "JP-A" as used herein means an unexamined published Japanese patent application.) These fountain solutions are advantageous in the safety aspect because of the absence of isopropyl alcohol, but have a problem in that they exhibit insufficient dampening of non-image areas during the printing in the PS plate using an anodically oxidized aluminum substrate, and, thus, in high speed printing, these fountain solutions may cause stains in the non-image areas and also cause a so-called "ink spreading" of dot image area, i.e., non-uniformity in the shape of dots in the image area.

However, these substitute solvents for isopropyl alcohol have been considered to be difficult to put into practical use since they generally have a low ability of for dissolution, and, particularly in a concentrated fountain solution, when water-soluble polymers are dissolved in cold or warm water, swollen particles of the polymers are aggregated to form a viscous mass called "undissolved powder lump" which is difficult to dissolve and which adversely affects workability. That is, these substitutes do not satisfy various characteristics required for a lithographic printing plate fountain solution substituting for gum arabic and still have serious defects.

SUMMARY OF THE INVENTION

An object of the present invention is to solve the above-described problems and to provide a composition for a lithographic printing fountain solution using a water-soluble polymer in place of gum arabic.

As a result of extensive studies for achieving the above object, the present inventors found that the above object can be easily solved by using the lithographic printing fountain solution composition described hereinbelow and have accordingly achieved the present invention.

More specifically, this and other objects of the present invention have been attained by a composition for a lithographic printing fountain solution (dampening water), which comprises polyvinyl alcohol containing itaconic acid, maleic acid (including maleic anhydride) or ester thereof in an amount of from 1 to 10 mol % per molecule as a copolymer component and having a saponification degree of from 80 to 100 mol % as a water-soluble polymeric compound.

That is, according to the present invention, the above-described various problems of the conventional composition for a lithographic printing fountain solution can be solved by using the above-described modified polyvinyl alcohol in place of gum arabic which has conventionally been used as a main component.

DETAILED DESCRIPTION OF THE INVENTION

A method for synthesis of the modified polyvinyl alcohol which can be used in the present invention comprises copolymerizing itaconic acid or maleic acid and vinyl acetate, followed by saponification, but the method is not limited thereto. For example, various methods are described in JP-A-4- 170405, and, further, as specific examples of modified polyvinyl alcohol, the compounds disclosed therein can be used in the present invention.

The amount of the composition according to the present invention contained in a fountain solution for lithographic printing plate is preferably from 0.0001 to 0.1% by weight, more preferably from 0.0003 to 0.05% by weight, per weight of the fountain solution actually used (hereinafter, simply referred to "fountain solution").

The composition according to the present invention may contain other water-soluble polymers. Examples of the polymers include natural substances and modified materials thereof such as gum arabic, starch derivatives (for example, dextrin, enzyme-decomposed dextrin, hydroxypropylated enzyme-decomposed dextrin, carboxymethylated starch, phosphorylated starch, octenylsuccinated starch), alginates, cellulose and derivatives thereof,(for example, carboxymethyl cellulose, carboxyethyl cellulose, methyl cellulose), and synthetic materials such as polyethylene glycol and copolymers thereof, polyvinyl alcohol and copolymers thereof, polyvinylpyrrolidone and copolymers thereof, polyacrylamide and copolymers thereof, polyacrylic acid and copolymers thereof, a vinyl methyl ether/maleic anhydride copolymer, and a vinyl acetate/maleic anhydride copolymer, and polystyrenesulfonic acid and copolymers thereof.

The amount of the above-described other water-soluble polymers is preferably from 0.0001 to 0.1% by weight, more preferably from 0.0005 to 0.05% by weight, per weight of the fountain solution.

In the composition for a fountain solution according to the present invention, a water-soluble organic acid and/or an inorganic acid or salts thereof can be used as a pH buffering agent, and these compounds are effective for pH adjustment or pH buffering of the fountain solution, and for an appropriate etching or anti-corrosion of the support for lithographic printing plates. Preferred examples of the organic acid include citric acid, ascorbic acid, malic acid, tartaric acid, lactic acid, acetic acid, gluconic acid, hydroxyacetic acid, oxalic acid, malonic acid, levulinic acid, sulfanilic acid, p-toluenesulfonic acid, phytic acid and organic phosphonic acid. Preferred examples of the inorganic acid include phosphonic acid, nitric acid, sulfuric acid and polyphosphonic acid. In addition, alkali metal salts, alkaline earth metal salts, ammonium salts or organic amine salts of these organic acids and/or inorganic acids can be suitably used, and these organic acid, inorganic acids and/or salts thereof may be used alone or as a mixture of two or more of these compounds.

The amount of these compounds contained in the fountain solution is preferably from 0.001 to 0.3% by weight. The fountain solution is preferably used in an acidic range at a pH value of from 3 to 7, but it may be used in an alkaline range at a pH value of from 7 to 11 containing alkali metal hydroxide, phosphoric acid, an alkali metal salt, a metal salt of alkali carbonate or a silicate salt.

If desired, the composition for a fountain solution according to the present invention may contain at least one compound of an ethylene oxide and/or propylene oxide adduct of 2-ethyl-1,3-hexanediol, and an ethylene oxide and/or propylene oxide adduct of acetylene alcohol or acetylene glycol to adjust the dynamic surface tension and/or to suppress a mixing ratio (an emulsifying ratio) of a printing ink to a suitable range. Examples of the acetylene alcohol or the acetylene glycol which are preferably used include an ethylene oxide and/or propylene oxide adduct of 2,4,7,9-tetramethyl-5-decyne-4,7-diol, 2,5-dimethyl-3-hexyne-2,5-diol, 3-methyl-l-butene-3-ol, 3-methyl-1-pentene-3-ol or 3,6-dimethyl-4-octene-3,6-diol. In the fountain solution, the above compound can be used in the range of from 0.0001 to 1% by weight.

Further, the composition for a fountain solution according to the present invention may contain surface active agents for the purpose of providing an ability to spread the fountain solution rapidly to the non-image area when the fountain solution is applied to the lithographic printing plate. Examples of anionic surface active agents for use in the present invention include fatty acid salts, abietic acid salts, hydroxyalkanesulfonates,alkanesulfonates,dialkylsulfosuccinates, straight chain alkylbenzenesulfonates, branched chain alkylbenzenesulfonate, alkylnaphthalenesulfonates, alkylphenoxy polyoxyethylene propylsulfonates, polyoxyethylene alkylsulfophenyl ether salts, N-methyl-N-oleyltaurin sodium salts, N-alkylsulfosuccinic acid monoamide disodium salts, petroleum sulfonates, sulfonated castor oils, sulfonated beef tallow, sulfonates of fatty acid alkyl esters, alkyl sulfonates, polyoxyethylene alkyl ether sulfonates, fatty acid monoglyceride sulfonates, polyoxyethylene alkylphenyl ether sulfonates, polyoxyethylenestyrylphenyl ether sulfonates, alkyl phosphonates, polyoxyethylene alkyl ether phosphonates, polyoxyethylene alkylphenyl ether phosphonates, partially saponified substances of styrene-maleic anhydride copolymer, partially saponified substances of olefin-maleic anhydride copolymer and naphthalenesulfonate-formalin condensates. Of these agents, in particular, dialkylsulfosuccinates, alkyl sulfonates and alkyl naphthalenesulfonates are preferably used.

Examples of non-ionic surface active agents include polyoxyethylene alkyl ethers, polyoxyethylene alkylphenyl ethers, polyoxyethylene polystyrylphenyl ethers, polyoxyethylene polyoxypropylene alkyl ethers, glycerin fatty acid partial esters, sorbitan fatty acid partial esters, pentaerythritol fatty acid partial esters, propylene glycol monofatty acid esters, sucrose fatty acid partial esters, polyoxyethylene sorbitan fatty acid partial esters, polyoxyethylene sorbitol fatty acid partial esters, polyethylene glycol fatty acid esters, polyglycerin fatty acid partial esters, polyoxyethylene castor oils, polyoxyethylene glycerin fatty acid partial esters, fatty acid diethanolamides, N,N-bis-2-hydroxyalkylamines, polyoxyethylene alkylamines, triethanolamine fatty acid esters and trialkylamine oxides. In addition, fluorine surface active agents, silicon surface active agents, and acetylene glycol ethylene oxide adducts can also be used. Of these agents, polyoxyethylene alkylphenyl ethers, polyoxyethylene-polyoxypropylene block polymers, and ethylene oxide adducts of acetylene glycol are preferably used.

Further, surface active agents such as silicon derivatives or fluorine derivatives can be used. Considering foaming of the fountain solution, a suitable amount of these surface active agents contained in the fountain solution is 1.0% by weight or less, preferably from 0.001 to 0.5% by weight.

Furthermore, the composition for a fountain solution according to the present invention may contain a moistening agent in order to prevent rapid evaporation of the fountain solution after being applied to the non-image area of the lithographic printing plate. For example, ethylene glycol, triethylene glycol, butylene glycol, hexylene glycol, diethylene glycol, glycerin, trimethylolpropane and diglycerin can be suitably used for this purpose. These moistening agents can be used alone or in a combination of two or more agents. Generally, the moistening agent in the fountain solution is preferably used in an amount of from 0.001 to 0.1% by weight.

Furthermore, the composition for a fountain solution according to the present invention may contain a chelating compound. Generally, the concentrated composition for fountain solution is used after diluting with tap water, well water or the like. In this case, a calcium ion and the like contained in the tap water or well water adversely affects the printing and is liable to cause staining on the prints. In such an instance, the above problem can be solved by adding a chelating compound. These chelating compounds are present stably in the composition for a fountain solution and selected from those which do not adversely affect the printing property. Preferred examples of the chelating compound include ethylenediaminetetraacetic acid, a potassium salt thereof and a sodium salt thereof; diethylenetriaminepentaacetic acid, a potassium salt thereof and a sodium salt thereof; triethylenetetraminehexaacetic acid, a potassium salt thereof and a sodium salt thereof; hydroxyethylethylenediaminetriacetic acid, a potassium salt thereof and a sodium salt thereof; nitrilotriacetic acid, a potassium salt thereof and a sodium salt thereof; 1-hydroxyethane-1,1-diphosphonic acid, a potassium salt thereof and a sodium salt thereof; and organic phosphonic acids such as aminotri (methylenephosphonic acid), a potassium salt thereof and a sodium salt thereof; and phosphonoalkanetricarbonic acids. Instead of the sodium salt or the potassium salt of the above chelating agents, organic amine salts of these chelating agents are also useful. A suitable amount of the chelating compound in the fountain solution is from 0.0001 to 1.0% by weight, preferably from 0.005 to 0.1% by weight.

Further, if desired, the composition of the present invention can be mixed with the following compounds to prepare a fountain solution. These compounds can be added for the purpose of providing adaptability to various fountain solution supply systems such as a direct water supply system or an indirect water supply system, or for the purpose of improving wettabiiity of water supply rollers.

Examples of these compounds include ethyl alcohol, isopropyl alcohol, n-propyl alcohol, n-butyl alcohol, isobutyl alcohol, ethylene glycol monomethyl ether, diethylene glycol monomethyl ether, triethylene glycol monomethyl ether, polyethylene glycol monomethyl ether, ethylene glycol monoethyl ether, diethylene glycol monoethyl ether, triethylene glycol monoethyl ether, ethylene glycol monobutyl ether, diethylene glycol monobutyl ether, triethylene glycol monobutyl ether, ethylene glycol monoisobutyl ether, diethylene glycol monoisobutyl ether, triethylene glycol monoisobutyl ether, ethylene glycol monopropyl ether, diethylene glycol monopropyl ether, triethylene glycol monopropyl ether, ethylene glycol mono-tertiary-butyl ether, diethylene glycol mono-tertiary -butyl ether, triethylene glycol mono-tertiary-butyl ether, ethylene glycol monohexyl ether, diethylene glycol monohexyl ether, triethylene glycol monohexyl ether, ethylene glycol monophenyl ether, diethylene glycol monophenyl ether, triethylene glycol monophenyl ether, propylene glycol, dipropylene glycol, tripropylene glycol, tetrapropylene glycol, propylene glycol monomethyl ether, dipropylene glycol monomethyl ether, tripropylene glycol monomethyl ether, propylene glycol monoethyl ether, dipropylene glycol monoethyl ether, tripropylene glycol monoethyl ether, tetrapropylene glycol monoethyl ether, propylene glycol monopropyl ether, dipropylene glycol monopropyl ether, tripropylene glycol monopropyl ether, propylene glycol monoisopropyl ether, dipropylene glycol monoisopropyl ether, tripropylene glycol monoisopropyl ether, propylene glycol monobutyl ether, dipropylene glycol monobutyl ether, tripropylene glycol monobutyl ether, propylene glycol monoisobutyl ether, dipropylene glycol monoisobutyl ether, tripropylene glycol monoisobutyl ether, propylene glycol mono-tertiary-butyl ether, dipropylene glycol mono-tertiary-butyl ether, tripropylene glycol mono-tertiary-butyl ether, and polypropylene glycols having a molecular weight of from 200 to 1,000 and monomethyl ethers, monoethyl ethers, monopropyl ether and isopropyl ether, monobutyl ethers of the polypropylene glycols. Of these compounds, ethylene glycol monobutyl ether, polypropylene glycols having a molecular weight of from 200 to 1,000, propylene glycol monopropyl ether, and monoalkyl ($C_1$–$C_4$) ether of propylene glycol having an average addition molar number of 2 to 7 are preferred. These compounds can be used alone or in a combination of two or more compounds, and the amount thereof which is suitably used in the fountain solution is from 0.1 to 5% by weight, more preferably from 0.5 to 3% by weight.

Further, a rust inhibitor, various coloring materials, a defoaming agent and a preservative may be added to the composition for a fountain solution of the present invention.

Examples of the rust inhibitor include benzotriazole, 5-methylbenzotriazole, thiosalicylic acid, benzimidazole and derivatives thereof.

Coloring materials for foods can be preferably used as coloring materials for the composition of the present invention. Examples of coloring materials include yellow coloring materials such as CI Nos. 19140 and 15985, red coloring material such as CI Nos. 16185, 45430, 16255, 45380 and 45100, purple coloring materials such as CI No. 42640, blue coloring materials such as CI Nos. 42090 and 73015 and green coloring materials such as CI No. 42095.

As a defoaming agent, a silicone defoaming agent is preferred, and, of these agents, any of the dispersion type and solubilized type may be used.

Examples of the preservatives which can be used include phenol or derivatives thereof, formalin, imidazole derivatives, sodium dehydroacetate, 4-isothiazolin-3-one derivatives, benzotriazole derivatives, amidine derivatives, guanidine derivatives, quaternary ammonium salts, pyridine derivatives, quinoline derivatives, guanidine derivatives, diazine derivatives, triazole derivatives, oxazole derivatives, oxazine derivatives, and bromonitropropanol. A preferred amount of the preservative to be added is a stably effective amount for bacteria, fungi, yeasts and the like, and preferably in the range of from 0.001 to 1.0% by weight, though the amount varies depending upon the type of bacteria, fungi and yeasts. Also, it is preferred that two or more preservatives which are effective against various bacterial, fungi and yeasts are used in combination.

Since the fountain solution composition according to the present invention is concentrated, it is preferred from the an economical standpoint that the composition is used by diluting it to 30 to 500 times the volume with tap water or well water upon use.

The present invention is further illustrated in greater detail by the following examples. Unless otherwise indicated, all percentages are by weight.

EXAMPLES

Compositions for fountain solution were prepared by using polyvinyl alcohol A to F and comparisons 1 and 2 shown in Table 1 below.

As compositions for fountain solution according to the present invention, Examples 1 to 6 shown in Table 2 below were prepared. Also, as compositions for fountain solution for comparison, Comparative Examples 7 and 8 shown in Table 3 were prepared. The unit of the components is grams, and water is added to the composition to make 1,000 ml.

TABLE 1

| | Polyvinyl Alcohol | | | |
|---|---|---|---|---|
| | Carboxyl Group-Containing Monomer | Content of Carboxyl Group-Containing Monomer Unit (mol %) | Degree of Saponification (mol %) | Viscosity of 4% Aqueous Solution (cps) |
| A | Itaconic Acid | 2.2 | 97.5 | 58.0 |
| B | Itaconic Acid | 3.5 | 84.0 | 125.0 |
| C | Maleic Anhydride | 1.4 | 96.5 | 83.8 |
| D | Monomethyl Itaconate | 7.6 | 94.2 | 240.4 |
| E | Monomethyl Maleate | 2.4 | 97.0 | 63.7 |
| F | Itaconic Acid | 4.6 | 98.5 | 50.3 |
| Comparison 1 | None | 0.0 | 98.5 | 55.0 |
| Comparison 2 | None | 0.0 | 88.4 | 59.2 |

TABLE 2

| | Examples | | | | | |
|---|---|---|---|---|---|---|
| | 1 | 2 | 3 | 4 | 5 | 6 |
| Water-soluble Resin | | | | | | |
| A | 15 | | | | | |
| B | | 10 | | | | |
| C | | | 15 | | | |
| D | | | | 10 | | |
| E | | | | | 15 | |
| F | | | | | | 15 |
| pH Buffering Agent | | | | | | |
| Phosphoric Acid | 7 | 7 | 7 | 7 | 7 | 7 |
| Ammonium Secondary Phosphate | 6 | 6 | 6 | 6 | 6 | 6 |
| Ammonium Tertiary Citrate | 10 | 10 | 10 | 10 | 10 | 10 |
| Nitrate | | | | | | |
| Magnesium Nitrate | 10 | 10 | 10 | 10 | 10 | 10 |
| Potassium Nitrate | 10 | 10 | 10 | 10 | 10 | 10 |
| Surface Active Agent | | | | | | |
| Oxyethylene Oxypropylene Block Copolymer (Pluronic L62 (produced by Asahi Denka Kogyo K.K.)) | 20 | 20 | 20 | 20 | 20 | 20 |
| Preservative Isothiazoline-Containing Compound "Biohope" (produced by K.I. Chemical Co., Ltd.) | 5 | 5 | 5 | 5 | 5 | 5 |
| Other Components | | | | | | |
| Ethylene Glycol Monobutyl Ether | 380 | 380 | 200 | 200 | 150 | 150 |
| Propylene Glycol Monopropyl Ether | | | 180 | 180 | 180 | 180 |
| Propylene Glycol Monobutyl Ether | | | | | 50 | 50 |
| Pure water to make 1,000 ml | | | | | | |

The liquid used for testing as a fountain solution was prepared by diluting the above composition with water to 40 times the volume and adjusting the pH to about 5.0 to 5.3 with sodium hydroxide.

TABLE 3

| | Comparative Examples | |
|---|---|---|
| | 7 | 8 |
| Water-soluble Resin | | |
| Comparison 1 | 15 | |
| Comparison 2 | | 15 |
| pH Buffering Agent | | |
| Phosphoric Acid | 7 | 7 |
| Ammonium Secondary Phosphate | 6 | 6 |
| Ammonium Tertiary Citrate | 10 | 10 |
| Nitrate | | |
| Magnesium Nitrate | 10 | 10 |
| Potassium Nitrate | 10 | 10 |
| Surface Active Agent Oxyethyleneoxypropylene Block Copolymer (Pluronic L62 (produced by Asahi Denka Kogyo K.K.) | 20 | 20 |
| Preservative Isothiazoline Containing-Compound "Biohope" (produced by K.I. Chemical Co., Ltd.) | 5 | 5 |
| Other Components | | |
| Ethylene Glycol Monobutyl Ether | 380 | 150 |
| Propylene Glycol Monopropyl Ether | | 180 |
| Propylene Glycol Monobutyl Ether | | 50 |
| Pure water to make 1,000 ml | | |

The liquid used for testing as a fountain solution was prepared by diluting the above composition with water to 40 times the volume and adjusting the pH to about 5.0 to 5.3 with sodium hydroxide.

Preparation Method and Conditions, and Solubility of Water-soluble Resin

Each of the water-soluble resins of Examples 1 to 6 and Comparative Examples 7 and 8 was dissolved using a stirrer Three-One-Motor (produced by Shinto Scientific Co., Ltd.) at a rotation of 400 r.p.m., and, after dissolving, other components were successively added to the solution and dissolved therein. The compositions of Comparative Examples 7 and 8 had poor solubility in cold water and therefore were dissolved by warming at a temperature of from 50° to 60° C. Comparative data on the solubility in water were shown in Table 4 below. As is apparent from the data, the compositions of Examples 1 to 6 using the water-soluble resins A to F according to the present invention have excellent water-solubility.

TABLE 4

| Comparison of Solubility in Water | | |
|---|---|---|
| | Dissolving Time | Condition |
| Example | | |
| 1 | 4 to 7 minutes | cold water |
| 2 | 8 to 10 minutes | cold water |
| 3 | 8 to 10 minutes | cold water |

TABLE 4-continued

| Comparison of Solubility in Water | | |
|---|---|---|
| | Dissolving Time | Condition |
| 4 | 4 to 7 minutes | cold water |
| 5 | 5 to 8 minutes | cold water |
| 6 | 5 to 8 minutes | cold water |
| Comparative Example | | |
| 7 | 2 to 3 hours | warm water of 50–60° C. |
| 8 | 2 to 3 hours | warm water of 50–60° C. |

Then, each of the stock solutions of fountain solution prepared in Examples 1 to 6 and Comparative Examples 7 and 8 was diluted with water at a ratio of 1:40, and the resulting fountain solution was evaluated for printing adaptability. The printing adaptability was evaluated by the printing test using Hidel Speed Master (Alcolor water-supply apparatus), MK-V Cyan Ink (produced by Toyo Ink Co., Ltd.) and the plate prepared from VPS (produced by Fuji Photo Film Co., Ltd.) under standard plate-making conditions. The results obtained by the evaluation on the printing adaptability are shown in Table 5 below.

TABLE 5

| | Examples | | | | | | Comparative Examples | |
|---|---|---|---|---|---|---|---|---|
| | 1 | 2 | 3 | 4 | 5 | 6 | 7 | 8 |
| Stains of Metering Rolls | A | A | A | A | A | A | C | C |
| Continuous Stability | A | A | A | A | A | A | C | C |

The evaluated methods are described below.

a. Stains of metering rolls: a degree of stains due to adhesion of ink to metering rolls for water-supply was evaluated as follows.
   A: Good
   B: Fair
   C: Poor
b. Ink-Bleeding: The operation of printing machine was discontinued when 5,000 and 10,000 sheets of prints were printed, and the bleeding of the printing ink in the image area to the non-image area was evaluated.
c. Emulsification: After printing 10,000 sheets, an ink on ink-kneading rolls was visually evaluated for any decrease in the concentration due to emulsification.
d. Continuous Stability: 10,000 sheets of prints were printed using pure water as a fountain solution and the amount of fountain solution which did not cause stains (a minimum amount of water feed) was determined. Then, printing was performed using each of the fountain solutions in the above minimum amount of water feed, and a number of prints before generation of stains in the prints was determined.
   A: 10,000 prints or more
   B: 3,000 to 10,000 prints
   C: 3,000 prints or less
e. Stability of Concentrated Stock Solution: The solution was placed in a polyethylene bottle, and the stability with time was observed at ambient temperature (room temperature); under the condition of 40° C. and 80% RH; and under the condition of–5° C.

f. Dropping Stability in Automatic Supplying Apparatus: The clogging of nozzle was investigated.

As shown in Table 5, the fountain solution according to the present invention was found to be excellent in (a) stains of metering rolls and (d) continuous stability and provided good prints, and also found to have excellent adaptability as fountain solution.

Further, the fountain solution according to the present invention also showed satisfactory results in the ink bleeding, the emulsification, the stability of concentrated stock solution and the dropping stability which are not shown in Table 5.

While the invention has been described in detail and with reference to specific embodiments thereof, it will be apparent to one skilled in the art that various changes and modifications can be made therein without departing from the spirit and scope thereof.

What is claimed is:

1. A composition for a lithographic printing fountain solution, which comprises polyvinyl alcohol containing itaconic acid, maleic acid, maleic anhydride or ester thereof in an amount from 1 to 10 mol % per molecule as a copolymer component and having a saponification degree of from 80 to 100 mol % and at least one compound selected from the group consisting of ethyl alcohol, isopropyl alcohol, n-propyl alcohol, n-butyl alcohol, isobutyl alcohol, ethylene glycol monomethyl ether, diethylene glycol monomethyl ether, triethylene glycol monomethyl ether, polyethylene glycol monomethyl ether, ethylene glycol monoethyl ether, diethylene glycol monoethyl ether, triethylene glycol monoethyl ether, ethylene glycol monobutyl ether, diethylene glycol monobutyl ether, triethylene glycol monobutyl ether, ethylene glycol monoisobutyl ether, diethylene glycol monoisobutyl ether, triethylene glycol monoisobutyl ether, ethylene glycol monopropyl ether, diethylene glycol monopropyl ether, triethylene glycol monopropyl ether, ethylene glycol mono-tertiary-butyl ether, diethylene glycol mono-tertiary-butyl ether, triethylene glycol mono-tertiary-butyl ether, ethylene glycol monohexyl ether, diethylene glycol monohexyl ether, triethylene glycol monohexyl ether, ethylene glycol monophenyl ether, diethylene glycol monophenyl ether, triethylene glycol monophenyl ether, propylene glycol, dipropylene glycol, tripropylene glycol, tetrapropylene glycol, propylene glycol monomethyl ether, dipropylene glycol monomethyl ether, tripropylene glycol monomethyl ether, propylene glycol monoethyl ether, dipropylene glycol monoethyl ether, tripropylene glycol monoethyl ether, tetrapropylene glycol monoethyl ether, propylene glycol monopropyl ether, dipropylene glycol monopropyl ether, tripropylene glycol monopropyl ether, propylene glycol monoisopropyl ether, dipropylene glycol monoisopropyl ether, tripropylene glycol monoisopropyl ether, propylene glycol monobutyl ether, dipropylene glycol monobutyl ether, tripropylene glycol monobutyl ether, propylene glycol monopropyl ether, dipropylene glycol monoisobutyl ether, tripropylene glycol monoisobutyl ether, propylene glycol mono-tertiary-butyl ether, dipropylene glycol mono-tertiary-butyl ether, tripropylene glycol mono-tertiary-butyl ether, and polypropylene glycols having a molecular weight of from 200 to 1,000 and monomethyl ethers, monoethyl ethers, monopropyl ether and isopropyl ether, and monobutyl ethers of the polypropylene glycols.

2. A composition for a lithographic printing fountain solution, which comprises polyvinyl alcohol containing itaconic acid, or maleic anhydride in an amount of from 1 to 10 mol % per molecule as a copolymer component and having a saponification degree of from 80 to 100 mol % and at least one compound selected from the group consisting of ethyl alcohol, isopropyl alcohol, n-propyl alcohol, n-butyl alcohol, isobutyl alcohol, ethylene glycol monomethyl ether, diethylene glycol monomethyl ether, triethylene glycol monomethyl ether, polyethylene glycol monomethyl ether, ethylene glycol monoethyl ether, diethylene glycol monoethyl ether, triethylene glycol monoethyl ether, ethylene glycol monobutyl ether, diethylene glycol monobutyl ether, triethylene glycol monobutyl ether, ethylene glycol monoisobutyl ether, diethylene glycol monoisobutyl ether, triethylene glycol monoisobutyl ether, ethylene glycol monopropyl ether, diethylene glycol monopropyl ether, triethylene glycol monopropyl ether, ethylene glycol mono-tertiary-butyl ether, diethylene glycol mono-tertiary-butyl ether, triethylene glycol mono-tertiary-butyl ether, ethylene glycol monohexyl ether, diethylene glycol monohexyl ether, triethylene glycol monohexyl ether, ethylene glycol monophenyl ether, diethylene glycol monophenyl ether, triethylene glycol monophenyl ether, propylene glycol, dipropylene glycol, tripropylene glycol, tetrapropylene glycol, propylene glycol monomethyl ether, dipropylene glycol monomethyl ether, tripropylene glycol monomethyl ether, propylene glycol monoethyl ether, dipropylene glycol monoethyl ether, tripropylene glycol monoethyl ether, tetrapropylene glycol monoethyl ether, propylene glycol monopropyl ether, dipropylene glycol monopropyl ether, tripropylene glycol monopropyl ether, propylene glycol monoisopropyl ether, dipropylene glycol monoisopropyl ether, tripropylene glycol monoisopropyl ether, propylene glycol monobutyl ether, dipropylene glycol monobutyl ether, tripropylene glycol monobutyl ether, propylene glycol monoisobutyl ether, dipropylene glycol monoisobutyl ether, tripropylene glycol monoisobutyl ether, propylene glycol mono-tertiary-butyl ether, dipropylene glycol mono-tertiary-butyl ether, tripropylene glycol mono-tertiary-butyl ether, and polypropylene glycols having a molecular weight of from 200 to 1,000 and monomethyl ethers, monoethyl ethers, monopropyl ether and isopropyl ether, and monobutyl ethers of the polypropylene glycols.

3. The composition of claim 1 wherein the at least one compound is present in an amount of from 0.1 to 5% by weight.

4. The composition of claim 1 wherein the at least one compound is present in an amount of from 0.5 to 3% by weight.

5. The composition of claim 2 wherein the at least one compound is present in an amount of from 0.1 to 5% by weight.

6. The composition of claim 2 wherein the at least one compound is present in an amount of from 0.5 to 3% by weight.

* * * * *